US006326932B1

(12) United States Patent
Mannan

(10) Patent No.: US 6,326,932 B1
(45) **Date of Patent: *Dec. 4, 2001**

(54) PLANAR ANTENNA ON ELECTRICALLY—INSULATING SHEET

(76) Inventor: Michael Mannan, 4 Becmead Avenue, Kenton, Harrow, Middlesex (GB), HA3 8EY ( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/765,872

(22) PCT Filed: Jul. 5, 1995

(86) PCT No.: PCT/GB95/01580

§ 371 Date: Mar. 5, 1997

§ 102(e) Date: Mar. 5, 1997

(87) PCT Pub. No.: WO96/02074

PCT Pub. Date: Jan. 25, 1996

(30) Foreign Application Priority Data

Jul. 8, 1994 (GB) ..... 9413828

(51) Int. Cl.[7] ..... H01Q 9/28
(52) U.S. Cl. ..... 343/795; 343/797

(58) Field of Search ..... 343/795, 797, 343/815, 702, 873; H01Q 9/28, 1/38

(56) References Cited

U.S. PATENT DOCUMENTS

| | | | | |
|---|---|---|---|---|
| 2,552,816 | * | 5/1951 | Root | 343/795 |
| 2,615,005 | * | 10/1952 | White | 343/795 |
| 3,025,524 | * | 3/1962 | Thies | 343/795 |
| 3,541,559 | * | 11/1970 | Evans | 343/795 |
| 3,641,576 | | 2/1972 | Farbanish | 343/743 |
| 3,721,990 | * | 3/1973 | Gibson et al. | 343/795 |
| 3,815,141 | | 6/1974 | Kigler | 343/795 |
| 4,860,019 | | 8/1989 | Jiang et al. | 343/795 |

FOREIGN PATENT DOCUMENTS

| | | |
|---|---|---|
| 0257657 A2 | 3/1988 | (EP) . |
| 1302644 | 1/1973 | (GB) . |

* cited by examiner

*Primary Examiner*—Michael C. Wimer
(74) *Attorney, Agent, or Firm*—Woodcock Washburn LLP

(57) ABSTRACT

A generally planar TV antenna having preferably at least two pairs of spaced-apart electrically conductive lands (3, 5; 7, 9) disposed on a sheet of electrically-insulating material (1) and method of manufacturing such antenna by providing the lands by hot foil blocking onto the sheet. The foil may also be formed by sputtering to the desired thickness.

9 Claims, 1 Drawing Sheet

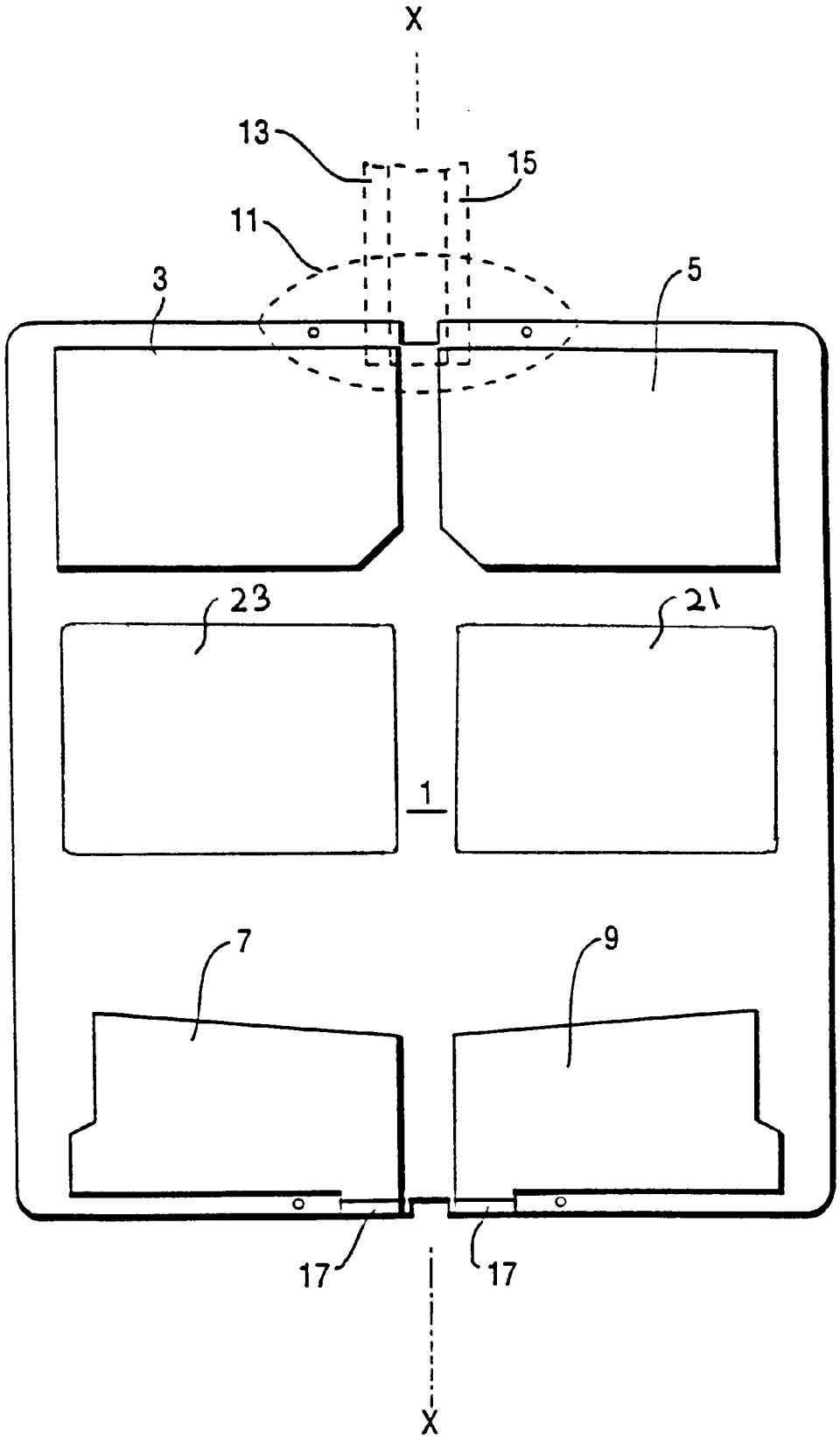
X
13
15
11
3
5
23
21
1
7
9
17
17
X

PLANAR ANTENNA ON ELECTRICALLY—INSULATING SHEET

BACKGROUND OF THE INVENTION

This invention relates to antennas. In one form it relates to an antenna which is particularly suitable for, but not limited to, receiving television signals. The invention is also applicable to antennas for radio transmission and reception.

Conventional television antennas are generally quite bulky and unsightly. In order to achieve best performance, outdoor antennas are preferred, for example, roof mounted antennas. However, these can be inconvenient to mount securely, and difficult to maintain. In the event of a storm, an outdoor antenna may easily become mis-aligned, or it may suffer damage.

Indoor antennas are commonly smaller than outdoor antennas for aesthetic reasons. However, their small size limits their efficiency, which means that they are generally suitable for reception only in areas where the television signals are strong. A tuned Yagi antenna has additional elements to increase gain, but this achieves high gain only along the front-rear direction of the antenna. Thus the antenna is highly directional and is also susceptible to receiving rear-reflected signals to cause ghosting. Typically the acceptance angle of a Yagi antenna is only about 20 degrees.

A lightweight FM-VHF-UHF antenna consisting of strip conductors disposed on a flexible plastics sheet has been proposed, see GB-A-1 302 644. The antenna is in 3 sections, one having the strip conductors disposed in a log periodic array, with the other two sections having the strip conductors disposed each in a Yagi-Uda array.

The present invention is concerned with providing a generally planar antenna of improved design, of compact size yet with sufficient gain for domestic television reception.

SUMMARY OF THE INVENTION

According to the present invention there is provided a generally planar antenna as specified in the claims hereinafter.

The antenna of the invention comprises at least one, and preferably at least two pairs of spaced-apart electrically-conducting lands acting as dipoles disposed on an electrically-insulating sheet material.

The antenna is designed to be deployed vertically broadside on to a transmitter generating horizontally-polarized signals. The antenna can be employed on its side, horizontally, for vertically-polarized signals.

The sheet material may be flexible (e.g. of plastics material) or it may be relatively rigid—for example a stiff cardboard sheet.

The electrically-conductive lands may be formed by a variety of means (e.g. printing, laminating, etching, evaporation), but preferably they are formed of foil (e.g. aluminium foil) hot pressed onto the sheet material.

An antenna feed arrangement is associated with one pair of lands, other pairs of lands (if present) act as a reflector. Three pairs of lands may be employed side-by-side with the feed being taken from any pair, for example the centre pair. With a vertically disposed antenna the feed is preferably taken from the bottom of the antenna.

Each pair of lands is preferably spaced-apart from and symmetrical about an imaginary line on the sheet material.

The first pair of lands may form a first symmetric shape with each further pair forming the same or different symmetric shapes.

Each land is a substantially two-dimensional area with an x-axis parallel to the imaginary line and a y-axis orthogonal thereto, with the maximum x-dimension of each land being approximately the same or similar to the maximum y-dimension. In other words each land extends substantially in both x- and y-directions—in contrast to a thin strip.

Each land may be generally rectangular or trapezoidal. The shape and dimensions of the lands, and their spacing, will vary the output of the antenna.

The lands do not need to be disposed on the same side of the sheet material although this is preferred.

A land of one pair may be capacitively coupled to a land of another pair (e.g. diagonally if two pairs of lands are side-by-side). This may be achieved by having these lands on opposite sides of the sheet material and extending the foil in a thin strip from one such land towards a similar strip from the other land (on the opposite side of the sheet) until the strips overlap capacitively. The sheet material acts as the capacitive dielectric.

In order to improve performance, means may be provided, such as a clip, for shorting together any pair of the lands not coupled to the antenna feed means. In certain circumstances this has proven to increase television band selectivity. The shorting may be controlled by a switch or by simply removing the clip.

If desired, to improve performance two or more antennas of the invention can be coupled together and stacked in series.

If the antenna is compact enough, it will be possible to integrate it with a domestic television receiver—for example in or on the back of the receiver or even (if the conductive lands are sufficiently thin and optically transmissive) on the viewing face of the cathode ray tube.

DETAILED DESCRIPTION OF THE INVENTION

A preferred antenna according to the invention, for use with a domestic television receiver, will now be described by way of example with reference to the accompanying drawing. The drawing shows the antenna face-on.

The antenna comprises a sheet 1 of stiff cardboard to which has been laminated by hot foil blocking four spaced aluminium foil lands 3,5,7 and 9. The aluminium foil is approximately $200\times10^{-10}$ metres in thickness, which gives an electrical resistance of about 1.5 ohms per square. The foil is overcoated with an electrically-insulating lacquer.

The arrangement may be manufactured by sputtering aluminium to the desired thickness onto a lacquer-coated backing surface. The aluminium is then coated with adhesive and the combination hot foil blocked onto the sheet 1 with the adhesive adjacent the sheet. The backing surface is peeled away to leave the sheet 1, lands 3, 5, 7, 9 and lacquer overcoating bonded together.

Each pair of lands 3,5 and 7,9 is spaced apart from and is symmetrical about an imaginary line x-x on sheet 1.

The antenna is designed for use in a vertical plane, e.g. mounted against a wall, and the feed for television signals can be obtained from either pair of lands. With the lands shaped as shown, taking feeds from lands 3,5 is effective for television bands A,B whereas feeds from lands 7,9 is more efficient for bands C,D.

The feed (shown to lands 3,5) consists of a clip 11 which presses a pair of strip conductors 13,15 down onto the lacquer at adjacent corners of the lands 3,5. The contact to the aluminium foil is capacitive through the intervening lacquer (it can also be a direct metal-to-metal contact, without intervening lacquer) Shorting the non fed pair of lands (7,9 as shown) can improve band selectivity, and this can be achieved by shorting across a small area 17 of exposed foil on each land.

The lands are spaced-apart in the y-direction (orthogonal to x-x) by 1 cm.

Lands 3,5 each have a maximum y-dimension of 22 cm and a maximum x-dimension of 12 cm. Lands 7,9 have a maximum y-dimension of 22 cm and a maximum x-dimension of 18 cm. At their closest approach lands 3,5 are spaced from lands 7,9 by 15 cm in the x-direction (parallel to x-x).

In a further embodiment which is a variant of that illustrated, the two lands 7 and 9 are merged to form one contiguous land extending transverse to x-x and symmetrically relative thereto, to act as a single reflector to lands 3 and 5.

What is claimed is:

1. A sheet antenna comprising:

a sheet of electrically-insulting material;

antenna feed means comprising an electric source, a first feed element connected to said electric source, and second feed element connected to said electric source;

a first pair of electrically conducting lands comprising a first land and a second land, said first land and said second land being disposed on said sheet, wherein said first land is electrically connected to said first feed element and said second land is electrically connected to said second feed element and said first land and said second land are positioned symmetric about and spaced apart from an imaginary line on said sheet; and a second pair of electrically conducting lands, comprising a third land and a fourth land, said third land and said fourth land being disposed on said sheet, wherein said second pair of lands is spaced-apart from said first pair of lands along the imaginary line, electrically-insulated from said first pair of lands, and wherein said third land and said fourth land are symmetric about the imaginary line wherein each land in said first and said second pair of lands is substantially two-dimensional with an x-axis parallel to the imaginary line and a y-axis orthogonal thereto, the maximum x-axis dimension being about the same as the maximum y-axis dimension for each said land.

2. An antenna as recited in claim 1, wherein each land is substantially trapezoidal in shape.

3. An antenna as recited in claim 1 further comprising a third pair of electrically conducting lands positioned symmetric about, and spaced apart from the imaginary line on said sheet, wherein one of said first, said second or said third pair of lands is positioned substantially between the remaining two pairs and is connected to said antenna feed means.

4. An antenna as recited in claim 1 wherein each land in said first and said second pair of lands comprises a conductive foil attached to said sheet of electrically-insulating material and having an electrically-insulating coating there over.

5. An antenna as recited in claim 1 wherein said antenna feed means capacitively couples to the lands of said first pair of electrically-conducting lands.

6. An antenna as recited in claim 5 wherein said antenna feed means comprises a clip having feed elements for attachment to said sheet material and for urging said feed elements into a capacitive coupling arrangement with the lands of said first pair of electrically-conducting lands.

7. An antenna as recited in claim 1 wherein said antenna is disposed vertically within or on a television receiver.

8. An antenna as recited in claim 1 wherein said antenna is wall-mounted.

9. A sheet antenna comprising:

a sheet of electrically-insulting material;

a first pair of electrically-conducting lands disposed on said sheet, positioned symmetric about and spaced apart from an imaginary line on said sheet;

antenna feed means comprising a first feed element and second feed element for forming respective feed connections to each land in said first pair of electrically-conducting lands; and a second pair of electrically conducting lands disposed on said sheet and spaced-apart from said first pair of lands along the imaginary line, electrically-insulated from said first pair of lands, and symmetric about the imaginary line, wherein each land in said first and said second pair of lands is substantially two-dimensional with an x-axis parallel to the imaginary line and a y-axis orthogonal thereto, the maximum x-axis dimension being about the same as the maximum y-axis dimension for each said land.

* * * * *